United States Patent [19]

Grants

[11] 4,225,539

[45] Sep. 30, 1980

[54] ROOM HUMIDIFIER AND THE HUMIDIFICATION SYSTEM

[76] Inventor: Paul R. Grants, 17D Cardinal St., Lakehurst, Ocean County, N.J. 08733

[21] Appl. No.: 948,529

[22] Filed: Oct. 4, 1978

[51] Int. Cl.[2] ..... B01F 3/04

[52] U.S. Cl. ..... 261/99; 239/55; 261/107; 261/DIG. 41

[58] Field of Search ..... 261/80–82, 261/99–107, DIG. 4, DIG. 14, DIG. 15, DIG.41, DIG. 65, DIG, 17; 95/17, 30, 105, 109; 237/78 R; 239/44, 45, 53, 55

[56] References Cited

U.S. PATENT DOCUMENTS

| | | | |
|---|---|---|---|
| 309,771 | 12/1884 | Davis | 98/109 |
| 1,534,875 | 4/1925 | Siday | 261/103 X |
| 1,606,472 | 11/1926 | Kieffer et al. | 261/104 |
| 1,959,926 | 5/1934 | Reich | 261/DIG. 14 |
| 1,994,523 | 3/1935 | Kohut | 261/104 |
| 2,022,740 | 12/1935 | Rowell | 261/105 |
| 2,045,941 | 6/1936 | Brody | 239/44 X |
| 2,068,431 | 1/1937 | Patterson | 261/106 |
| 3,537,692 | 11/1970 | Vick | 261/DIG. 15 |
| 3,823,922 | 7/1974 | McElreath | 261/DIG. 15 |
| 3,867,096 | 2/1975 | Doucette | 239/53 X |
| 4,101,609 | 7/1978 | Sumrow | 261/105 |
| 4,146,597 | 3/1979 | Eckstein et al. | 261/104 |

FOREIGN PATENT DOCUMENTS

| | | | |
|---|---|---|---|
| 959409 | 12/1974 | Canada | 261/103 |
| 4791 | of 1915 | United Kingdom | 261/106 |

*Primary Examiner*—Richard L. Chiesa

*Attorney, Agent, or Firm*—Clarence A. O'Brien; Harvey B. Jacobson

[57] ABSTRACT

A room humidifier unit operable in conjunction with the natural circulation of the room's air, comprising a portable, self-contained and angularly adjustable evaporator for positioning in the flow path of the room's natural air circulating flow to obtain maximum evaporation, and a system wherein two or more of the units are used and positioned in spaced flow path portions of the circulating room air.

8 Claims, 7 Drawing Figures

ROOM HUMIDIFIER AND THE HUMIDIFICATION SYSTEM

BACKGROUND OF THE INVENTION

1. Field of the Invention

The present invention generally relates to a noiseless room humidifier which is not dependent upon a source of electrical potential for effective opertion.

2. Description of the Prior Art

The prior art, as in U.S. Pat. Nos. 309,771, 1,790,993, 3,227,064 3,278,175 3,497,188 3,673,770 and some other discloses room appliance-type humidifiers having their evaporators directly connected with built-in soaking pans and with the evaporators being prearranged to operate in conjunction with a predetermined unchanging air flow path and as such they are neither claimed nor are they suited to perform with full efficiency under the often varying natural path of the air circulating in a room.

The present invention also relates to improvement on my "Noiseless Humidifier With Rotatably Repositionable Evaporator" disclosed in my prior U.S. application Ser. No. 893,337, filed Apr. 4, 1978, now abandoned.

SUMMARY OF THE INVENTION

The primary object of this invention is to provide a humidification assemblage which will be capable of performing noiselessly and efficiently by utilizing the moisture absorbing capacity of the air in a room as the air circulates, naturally, about the room and without employing any power source to create forced air circulation, thus saving energy and its expense and eliminating the noises usually associated with such power sources.

Another object of this invention is to provide a humidification system employing a highly sensitive evaporator unit consisting, preferably, of rows of multiple, open sided, hollow core and tube-like strips of a water absorbent material supported in spaced apart relation as to comprise a panel-like evaporator unit. The strips are tubular and may be of rectangular, octogonal or other cross-sectional shapes wherein the hollow interiors of the cores provide a free air flow therethrough and thus assists in rapid evaporation of water from the strips. The evaporator unit is provided with a meshtype enclosure and the enclosure is equipped with suitably arranged pivot pins or hinges enabling the enclosure to be angularly displaced, as desired, for effective disposition in the natural air circulating air flow of a room.

The efficiency of this type of humidifier depends mainly upon the efficient use of the comparatively weak room air circulating currents and, therefore, further object of this invention is to provide the humidification assemblage with supporting brackets or pedestals or the like of such character which enables the humidification unit enclosures to be readily positioned most advantageously in any portions of the air paths of natural room air circulation and with the enclosures optimumly positioned relative to the associated portion of the natural air flow in the room.

Yet another object of this invention is to provide a humidifier unit in accordance with the preceding objects and including supporting brackets or pedestals which themselves are shiftable relative to the supporting surfaces therefor and which, therefore, further facilitate optimum positioning of the humidification unit.

Another object of this invention is to incorporate two or more humidification units in a humidification system wherein two or more humidification units are being used and are optimumly positioned relative to spaced portions of the natural air circulation path in a room.

Another important object of this invention is to provide supportive brackets or pedestals including humidifier unit supporting brackets thereof which are substantially identical and which therefore enable a single humidifier unit to be alternately supported from a support bracket or pedestal.

A still further object of this invention is to provide a humidification system which, in addition to conserving energy by exploiting evaporation as a result of convection currents, will be helpful as well as safe and simple to operate and maintain.

Another object of this invention to be specifically enumerated herein is to provide a room humidification assemblage in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
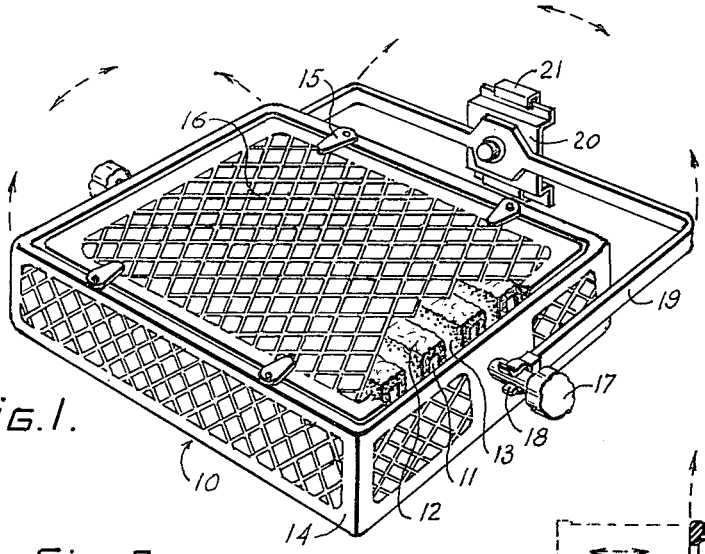
FIG. 1 is a perspective view of a typical form of humidification unit constructed in accordance with the present invention and with portions of the mesh enclosure and tubular evaporation strips broken away and illustrated in vertical section.

Referring now more specifically to the drawings, the numeral 10 generally designates a first form of evaporator unit illustrated in FIG. 1. The evaporator unit 10 includes a plurality of hollow core 11 type water absorbent evaporative strips 12 disposed in parallel laterally spaced relation to define air spaces 13 therebetween. The strips 12 are housed within a mesh-type enclosure 14 including an open side and clips 15 supported from the enclosure 14 about the open side thereof and for angular displacement relative to the enclosure 14. A removable closure will portion 16, also of mesh construction and preferably constructed of plastic, is disposed over the open side of the enclosure 14 and removably retained in position over the strips 12 by the pivotal clips 15.

The opposite ends of the enclosure 14 include pivot shank mounted handles 17 and springs clip-type bearings 18 are supported from the free ends of the arms of a bifurcated rack 19. Accordingly, the unit 10 may be rotated relative to the rack 19 about a first axis extending along the center line of the shank poriton supporting the handles 17. Also, the rack 19 is pivotally supported from a channel-shaped base 20 for angular displacement relative thereto about a second axis disposed substantially normal to the first axis. The base 20 is slidably engageable with a bracket 21 adapted to be supported from any suitable surface by means of screw-type fasteners for support of the base 20 from that wall surface.

Figure 2:
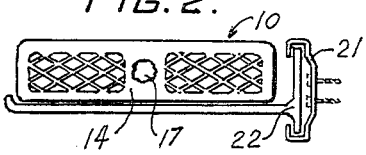
FIG. 2 is an end elevational view of a first modified form of evaporation unit supported from and which may be flipped relative to a stationary wall mounted support rack.

With attention now invited more specifically to FIG. 2 of the drawings, there may be seen a second form of supporting rack 22 including a horizontal arm portion and a base portion, similar to the base portion 20, carried by one end of the arm portion and also removably slidably engageable with the bracket 21 whereby the modified rack 22 may be supported from the bracket 21 with the arm portion of the rack 22 substantially horizontally disposed. In this embodiment of the invention, the unit 10 may be placed upon the rack 22 in the manner illustrated in FIG. 2 and alternately flipped in position on the rack 22 whenever desired.

Figure 4:
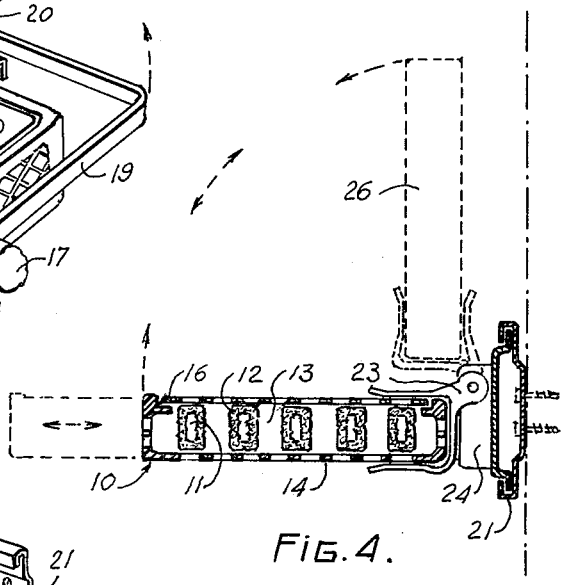
FIG. 4 is a vertical transverse sectional view taken substantially upon the plane indicated by the section line 4—4 of FIG. 3 with alternate positions of the humidification unit illustrated in phantom line and on somewhat of an enlarged scale.
Figure 6:
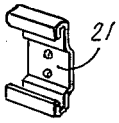
FIG. 6 is a perspective view of a preferred form of wall mounted bracket for use in conjunction with those forms of the invention illustrated in FIGS. 1 and 4 and which is also usable atop the pedestal in that form of the invention illustrated in FIG. 5.
Figure 3:
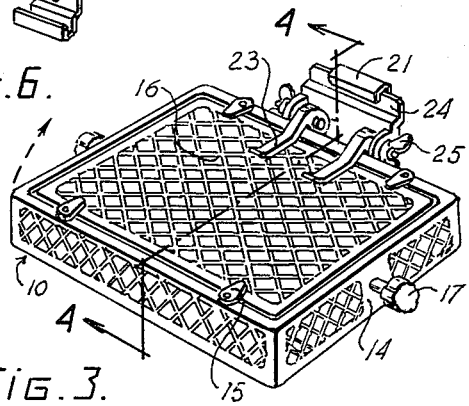
FIG. 3 is a perspective view of a second modified form of humidification unit utlilizing a hingedly supported mount.
Figure 7:
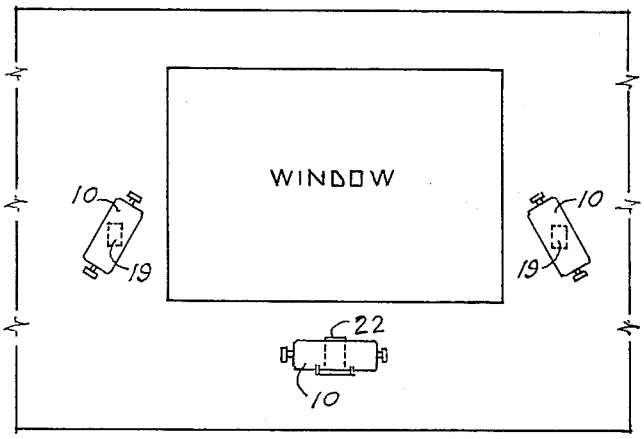
FIG. 7 is a schematic view illustrating the manner in which a plurality of humidification units constructed in accordance with the present invention may be positioned in spaced relation within a room whereby to be optimumly positioned relative to the nature circulation of air within the room.

A third form of the invention is illustrated in FIGS. 3 and 4 of the drawings and utilizes an evaporator unit 10 similar to that shown in FIGS. 1 and 2 and supported from a pair of laterally spaced apart C-shaped support clips 23 pivotally supported from a base 24 by friction-type pivot fasteners 25. The unit 10 illustrated in FIGS. 3 and 4 may be manually withdrawn from the supporting clips 23 in the manner illustrated in the left hand phantom line designation in FIG. 4 and the unit 10 may further be pivoted to the vertical phantom line position 26 illustrated in FIG. 4. Thus, the unit 10, when supported form the clips 23, may be variously positioned as desired.

Figure 5:
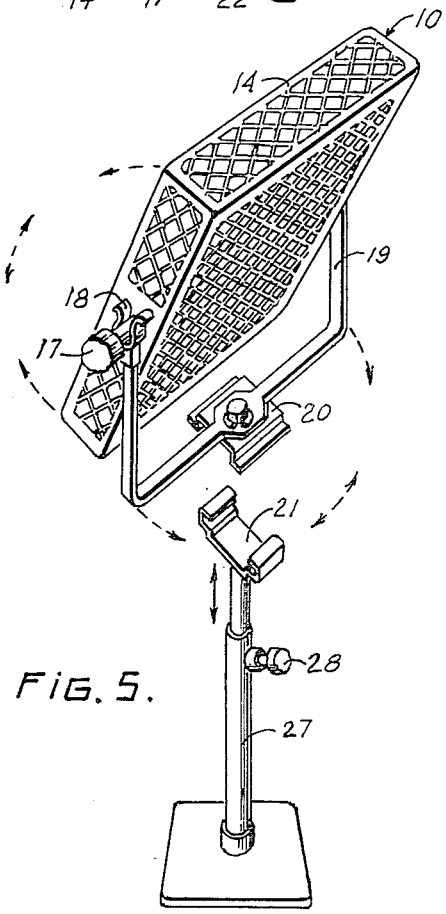
FIG. 5 is an exploded perspective view of another modified form of humidification unit utilizing an adjustable height pedestal for its support, the unit being illustrated in exploded position relative to the pedestal.

With attention now invited more specifically to FIG. 5 of the drawings, there will be seen a fourth form of assemblage wherein the supporting rack 19 and base 20 of FIG. 1 are utilized and a bracket 21, such as that provided in FIGS. 1, 2, and 3 is mounted atop the upper telescopingly adjustable standard portion of a pedestabl 27 including a lock screw 28 for retaining the pedestal in adjusted extended positons. Of course, the pedestal 27 may be supported from the floor of a room in any suitable location therein in order to optimumly position the unit 10 relative to an adjacent portion of the path of natural air circulation through the room.

With attention now invited more specifically to FIG. 17 of the drawings, there may be seen an example of possible positioning of a plurality of units 10 positioned about a window opening in a wall for optimum positioning of the unit 10 relative to various portions of the path of natural air circulation within the room.

What is claimed as new is as follows:

1. In combination with a room having interior boundary surfaces and subject to occasional varying natural paths of air circulation therein, a plurality of support structures supported upon selected portions of said boundary surfaces, a plurality of mesh-type housings, said housings and said support structures including coating portions supporting said housings from said support structures for manual angular displacement of said housing relative to said support structures, a plurality of elongated tubular water absorbent evaporator elements open at their opposite ends and supported within each of said housings in spaced apart relation therewithin for effecting air flow thereover in an efficient manner to evaporate water from said elements when said housings are optimumly positioned in space portions of the natural path of air circulation in said room.

2. The combination of claim 1 wheren said support structures include wall surface mounted brackets, said coacting portions supporting said housing from the corresponding support structures for adjusted angular displacement relative thereto.

3. The combination of claim 1 including a support standard, at least one of said support structures being mounted atop said standared for vertical adjustment relative to the lower end of the standard and also angular adjustment relative to the lower end of the standard about an upstanding axis.

4. The combination of claim 1 wherein said support structures include wall surface mounted brackets, said coacting portions supporting said housings from the corresponding support structures for adjusted angular displacement relative thereto, wherein said coacting portions include aligned opposite end shank portions on said housings and U-shaped support racks supported from said support structures and including free arm end portions from which said shank portions are journaled.

5. The combination of claim 4 wherein said coacting portions include means supporting said U-shape racks from said support structures for angular displacement of said racks relative to said support structures about axes generally paralleling the arms of said racks.

6. The combination of claim 1 wherein said support structures include wall surface mounted brackets, said coacting portions supporting said housings from th corresponding support structures for adjusted angular displacement relative thereto, said coacting portions including means swingably support said housings for angular displacement relative to the corresponding support structures about axes generally paralleling the corresponding boundary surfaces.

7. the combination of claim 1 wherein said support structures include wall surface mounted brackets, said coacting portions supporting said housings from the corresponding support structures for adjusted angular displacement relative thereto, said coacting portions including a horizontal arm portion supported from said support structure and opposite generally flat sides of said housings which may be alternately supported from said arm portion.

8. The combination of claim 1 wherein said housings include open sides through which said elements are removably receivable, and mesh-type closures for said open sides of said housings removably supported therefrom.

* * * * *

UNITED STATES PATENT AND TRADEMARK OFFICE

CERTIFICATE OF CORRECTION

PATENT NO. : 4,225,539

DATED : September 30, 1980

INVENTOR(S) : Paul R. Grants

It is certified that error appears in the above-identified patent and that said Letters Patent are hereby corrected as shown below:

Column 4, line 10, delete "coating"

and insert --coacting--.

Signed and Sealed this

*Seventh* Day of *April 1981*

[SEAL]

*Attest:*

RENE D. TEGTMEYER

*Attesting Officer*

*Acting Commissioner of Patents and Trademarks*